US008882220B2

(12) United States Patent
Nishikawa

(10) Patent No.: US 8,882,220 B2
(45) Date of Patent: Nov. 11, 2014

(54) PRINTING APPARATUS HAVING MULTIPLE CONTROL UNITS TO CONTROL DRIVING OF PRINTHEAD

(75) Inventor: Yukinori Nishikawa, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 25 days.

(21) Appl. No.: 13/568,383

(22) Filed: Aug. 7, 2012

(65) Prior Publication Data

US 2013/0050318 A1 Feb. 28, 2013

(30) Foreign Application Priority Data

Aug. 25, 2011 (JP) ..... 2011-184062

(51) Int. Cl.
*B41J 29/38* (2006.01)
*B41J 19/20* (2006.01)
*B41J 29/02* (2006.01)

(52) U.S. Cl.
CPC ..... *B41J 29/38* (2013.01); *B41J 19/202* (2013.01); *B41J 29/02* (2013.01)
USPC ..... 347/11

(58) Field of Classification Search
CPC ..... B41J 29/38; B41J 19/202; B41J 29/02
USPC ..... 347/11, 12, 19
See application file for complete search history.

(56) References Cited

U.S. PATENT DOCUMENTS

| | | | | |
|---|---|---|---|---|
| 5,936,645 | A | 8/1999 | Niikura et al. | |
| 7,014,289 | B1 * | 3/2006 | Matsuda | 347/19 |
| 2005/0270320 | A1 * | 12/2005 | Hiwada et al. | 347/12 |

FOREIGN PATENT DOCUMENTS

| | | | |
|---|---|---|---|
| JP | 7-205485 | A | 8/1995 |
| JP | 7-205487 | A | 8/1995 |

* cited by examiner

*Primary Examiner* — Laura Martin
*Assistant Examiner* — Carlos A Martinez
(74) *Attorney, Agent, or Firm* — Fitzpatrick, Cella, Harper & Scinto

(57) ABSTRACT

An encoder sensor is mounted on a printhead and optically reads an encoder film. And a number of pulses of a pulse signal proportional to a moving amount of a printhead is counted and stored as a count value in a memory within multiple ICs. The count value stored in the memories is reset while the pulse signal outputted from the encoder sensor is blocked by a gate or while a region other than near a boundary between a penetration region and a non-penetration region of the encoder film is being read.

12 Claims, 13 Drawing Sheets

PRINTING APPARATUS HAVING MULTIPLE CONTROL UNITS TO CONTROL DRIVING OF PRINTHEAD

BACKGROUND OF THE INVENTION

1. Field of the Invention

The present invention relates to printing apparatuses that detect a position of a carriage using an encoder sensor.

2. Description of the Related Art

Conventionally, inkjet printing apparatuses are known that carry out image printing onto a printing medium by discharging ink from nozzles of a printhead. Generally, these inkjet printing apparatuses are provided with a carriage on which a printhead and an ink tank are mounted, a conveyance mechanism that conveys the printing medium, and a control mechanism that controls operations of these. The carriage, on which is mounted the printhead from which ink droplets are discharged from multiple nozzles, is caused to scan in a direction (main scanning direction) that is orthogonal to a conveyance direction (sub scanning direction) of printing papers. The inkjet printing apparatus is able to carry out printing of an entire image region by performing multiple scan and conveyance operations of the printing medium in which ink is discharged onto the printing medium during each scan while on the other hand the printing medium is intermittently conveyed between each scan. In a case of carrying out color image printing, this is achieved by overlaying ink droplets discharged from multiple printheads corresponding to multiple types of ink colors, or by causing the ink droplets to land adjacent to each other.

When the carriage is caused to scan, encoder signals, which are constituted by an A phase signal and a B phase signal as shown in FIGS. 12A and 12B, are outputted from an optical or magnetic rotary encoder or linear encoder provided on the carriage. Here, it is usual for the A phase signal and the B phase signal to have a phase difference of 90 degrees from each other. The inkjet printing apparatus is able to specify the scanning direction (forward direction or return direction) and the position of the carriage according to these encoder signals. In Japanese Patent Laid-Open Nos. 07-205485 and 07-205487, description is given of an encoder counter referencing the above-mentioned encoder signals and increasing or decreasing a counter value in response to the scanning direction of the carriage, thereby obtaining a relative distance from a predetermined carriage reference position.

In recent years, accompanying higher resolutions and a greater number of nozzles in the printhead of inkjet printing apparatuses, the scale of the control circuits of printhead is also increasing. Accompanying higher resolutions and a greater number of nozzles in the printhead, it is common for the control circuits of the printhead to be configured as shown in FIG. 13. That is, as shown in FIG. 13, the printhead is divided into multiple control units in the manner of control unit 1, control unit 2, and so on up to a control unit n, and control is performed in regard to each printhead control unit by a printhead control IC 1, printhead control IC 2, printhead control IC 3, and so on up to a printhead control IC n corresponding to the printhead control units referencing the encoder signals from the encoder.

Configurations such as that shown in FIG. 13 are commonly used since they have the merit of enabling shorter development times and reducing costs due to the configuration of each of the ICs being simpler compared to a case where control of the printhead control units is performed from a single control circuit. Furthermore, there is also the merit that configurations can be achieved flexibly using multiple printhead control ICs in cases where the printhead control units vary according to the model of inkjet printing apparatus.

There are various methods available for resetting the encoder counter inside each of the printhead control ICs to set the carriage reference position with the configuration shown in FIG. 13. For example, as shown in FIG. 14, there is a method by which a register of the encoder counter inside each of the printhead control ICs is reset by the CPU via a bus. Furthermore, as shown in FIG. 15, there is a method in which a common encoder counter reset signal is connected to each of the printhead control ICs, and the register of the encoder counter inside each of the printhead control ICs is reset according to the encoder counter reset signal after causing the carriage to stop.

In the configurations shown in FIG. 14 and FIG. 15, it is extremely difficult to reset the encoder counter register in each of the printhead control ICs using a same timing. This is because in the configuration shown in FIG. 14, the CPU carries out sequential reset operations for the printhead control ICs, and therefore it is not possible to perform the reset operation for all the printhead control ICs using the same timing. In the configuration shown in FIG. 15, the printhead control ICs can undergo the reset operation in common according to the encoder counter reset signal, but due to internal skew differences originating in manufacturing discrepancies of each of the printhead control ICs, the timing for the resets cannot be made simultaneous.

Chattering sometimes occurs in the encoder signal according to the positional relationship between the carriage and the encoder slits. That is, in a case where the carriage is in such a position, the encoder signal becomes unstable. In the configurations shown in FIG. 14 and FIG. 15, suppose for example that a reset operation is carried out in a printhead control IC having a CPU. And if there is undesirable oscillation in the encoder signal when a reset operation is to be carried out in a different printhead control IC at a timing shifted from that time point, then the count value advances undesirably in the printhead control IC for which the reset operation was carried out initially. That is, unfortunately the carriage reference positions become set differently between the printhead control ICs. When the settings of the reference positions between each of the printhead control ICs become undesirably different, the registration shifts between the printhead control units controlled by each of the printhead control ICs, which incurs a deterioration in image quality.

SUMMARY OF THE INVENTION

An aspect of the present invention is to eliminate the above-mentioned problems with the conventional technology.

The present invention provides a printing apparatus in which an encoder counter reset operation is carried out stably without being influenced by an unstable state of the encoder signal.

The present invention in its first aspect provides a printing apparatus, comprising: a generation unit configured to generate a first pulse signal and a second pulse signal which phase is shifted to the first pulse signal, wherein the first and second pulse signal are associated with movement of a printhead; multiple control units configured to control driving of a plurality of parts of a printhead, wherein each of multiple control units includes a count unit that counts the first pulse signal and the second pulse signal, and controls driving of one of the plurality of parts of the printhead based on the first pulse signal and the second pulse signal; a supply unit configured to supply the first pulse signal and the second pulse signal to the multiple control units; and a stopping unit configured to stop supply of the first pulse signal and the second pulse signal by the supply unit while a count value counted by the count unit is set to a predetermined value.

According to the present invention, an encoder counter reset operation can be carried out stably without being influenced by an unstable state of the encoder signal.

Further features of the present invention will become apparent from the following description of exemplary embodiments with reference to the attached drawings.

DESCRIPTION OF THE EMBODIMENTS

Preferred embodiments of the present invention will now be described hereinafter in detail, with reference to the accompanying drawings. It is to be understood that the following embodiments are not intended to limit the claims of the present invention, and that not all of the combinations of the aspects that are described according to the following embodiments are necessarily required with respect to the means to solve the problems according to the present invention. It should be noted that same reference numbers are assigned to same compositional elements and description thereof is omitted.

Embodiment 1

Description of Inkjet Printing Apparatus

Figure 1:
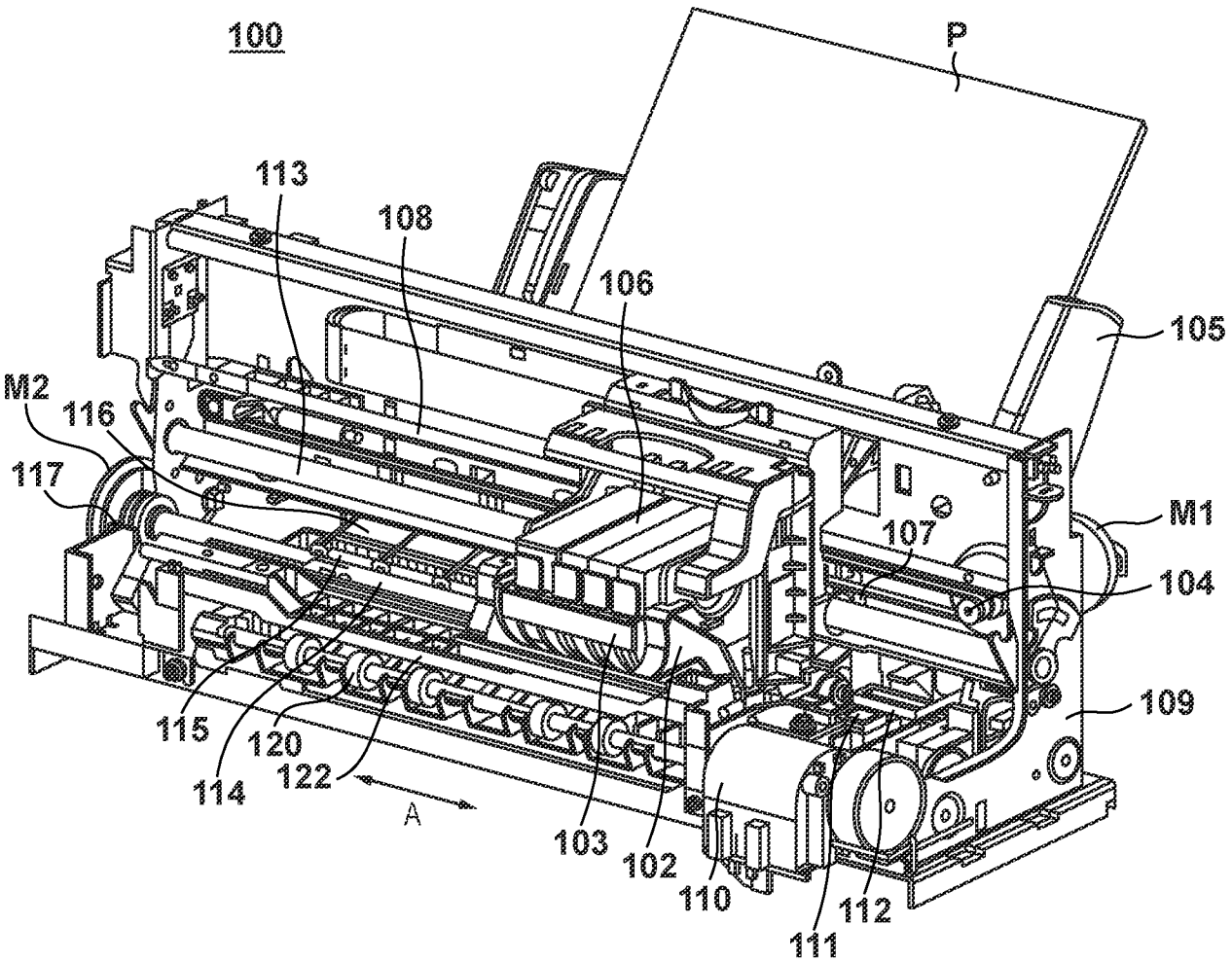
FIG. 1 is an external perspective view showing an outline of a configuration of an inkjet printing apparatus.

FIG. 1 is an external perspective view showing an outline of a configuration of an inkjet printing apparatus, which is a representative embodiment of the present invention.

As shown in FIG. 1, in an inkjet printing apparatus 100, a drive force generated by a carriage motor M1 is transmitted by a transmission mechanism 104 to a carriage 102 on which is installed printhead 103 that carry out printing by discharging ink according to an inkjet method, and the carriage 102 is caused to move in a reciprocal manner in an arrow A direction. For example, printing is carried out by using a paper feeding mechanism 105 to feed a printing medium P such as a printing paper and convey it to a printing position, then discharging ink onto the printing medium P from the printhead 103 at that printing position.

Furthermore, to maintain the printhead 103 in good condition, the carriage 102 is moved to a position of a recovery device 110, and a discharge recovery process of the printhead 103 is carried out intermittently.

In addition to the printhead 103 mounted on the carriage 102 of the inkjet printing apparatus 100, ink cartridges 106 are also installed that store ink to be supplied to the printhead 103. The ink cartridges 106 are readily detachable from the carriage 102.

The inkjet printing apparatus 100 shown in FIG. 1 is capable of color printing, and for this purpose four ink cartridges are mounted on the carriage 102 to accommodate magenta (M), cyan (C), yellow (Y), and black (K) ink respectively. Each of these four ink cartridges can be detached independently.

The carriage 102 and the printhead 103 are configured so that the surfaces where they join contact appropriately to establish and maintain a necessary electrical connection. By having energy applied in response to a printing signal, the printhead 103 selectively discharge ink from multiple discharge orifices to perform printing. In particular, the printhead 103 according to the present embodiment employ an inkjet method in which ink is discharged using thermal energy, and are provided with an electrothermal transducer for generating thermal energy, wherein the electrical energy applied to the electrothermal transducer is converted to thermal energy, and ink is caused to discharge through the discharge orifices by using pressure changes produced by the expansion and contraction of bubbles caused by film boiling that is produced by this thermal energy being applied to the ink. One of these electrothermal transducers is provided for each of the discharge orifices, and ink is discharged from the corresponding discharge orifice by applying a pulse voltage to the corresponding electrothermal transducer in response to the print signal.

As shown in FIG. 1, the carriage 102 is coupled to a portion of a drive belt 107 of the transmission mechanism 104 that transmits the drive force of the carriage motor M1, and is guided and supported so as to readily slide in the arrow A direction along a guide shaft 113. Accordingly, the carriage 102 moves reciprocally along the guide shaft 113 due to forward rotation and reverse rotation of the carriage motor M1. Furthermore, a scale 108 (CR encoder film) is provided for indicating the position of the carriage 102 along the movement direction (arrow A direction) of the carriage 102. In this embodiment, a transparent PET film on which black bars are printed at a required pitch is used as the scale 108, one end of which is secured to a chassis 109 and the other end of which is supported by a blade spring (not shown in diagram).

Furthermore, a platen (not shown in diagram) is provided in the inkjet printing apparatus 100 opposing a discharge orifice surface in which the discharge orifices (not shown in diagram) of the printhead 103 are formed, and printing is carried out across the entire width of the printing medium P conveyed on the platen by applying print signals to the printhead 103 to eject ink at the same time that the carriage 102 on which the printhead 103 are mounted moves reciprocally due to the drive force of the carriage motor M1.

Further still, a conveyance roller 114 in FIG. 1 is driven by a conveyance motor M2 for conveying printing media P. Furthermore, due to a spring (not shown in diagram), a pinch roller 115 causes the printing medium P to contact the conveyance roller 114. Furthermore, a pinch roller holder 116 rotatably supports the pinch roller 115. Furthermore, a conveyance roller gear 117 is secured to one end of the conveyance roller 114. And the conveyance roller 114 is driven by rotation of the conveyance motor M2 transmitted through an intermediate gear (not shown in diagram) to the conveyance roller gear 117.

Furthermore, a discharge roller 120 discharges the printing medium P on which an image has been formed by the printhead 103 to outside the inkjet printing apparatus. The discharge roller 120 is configured to be driven by the rotation of the conveyance motor M2 being transmitted. It should be noted that the discharge roller 120 contacts the printing medium P due to a spur roller (not shown in diagram) that presses due to a spring (not shown in diagram). A spur holder 122 rotatably supports the spur roller.

Furthermore, in the inkjet printing apparatus 100, as shown in FIG. 1, the recovery device 110 for recovering discharge faults of the printhead 103 is arranged in a desired position (for example, a position corresponding to a home position) outside a reciprocal movement region (outside a printing region) for printing operations of the carriage 102 on which the printhead 103 are mounted.

The recovery device 110 is provided with a capping mechanism 111, which caps the discharge orifice surface of the printhead 103, and a wiping mechanism 112, which cleans the discharge orifice surface of the printhead 103, and carries out a discharge recovery process in which, for example, in cooperation with capping of the discharge orifice surface by the capping mechanism 111, ink is forcibly ejected from the discharge orifices using a suction system (suction pump or the like) inside the recovery device, thereby eliminating air bubbles or ink whose viscosity has increased inside the ink channels of the printhead 103.

Furthermore, by capping the discharge orifice surface of the printhead 103 using the capping mechanism 111 during such times as a nonprinting operation time, it is possible to protect the printhead 103 and to prevent the evaporation and drying of ink. On the other hand, the wiping mechanism 112 is arranged near the capping mechanism 111, and is configured to wipe off droplets of ink liquid that have adhered to the discharge orifice surface of the printhead 103.

With the capping mechanism 111 and the wiping mechanism 112, it is possible to maintain a normal state of ink discharge of the printhead 103.

Control Configuration of Inkjet Printing Apparatus

Figure 2:
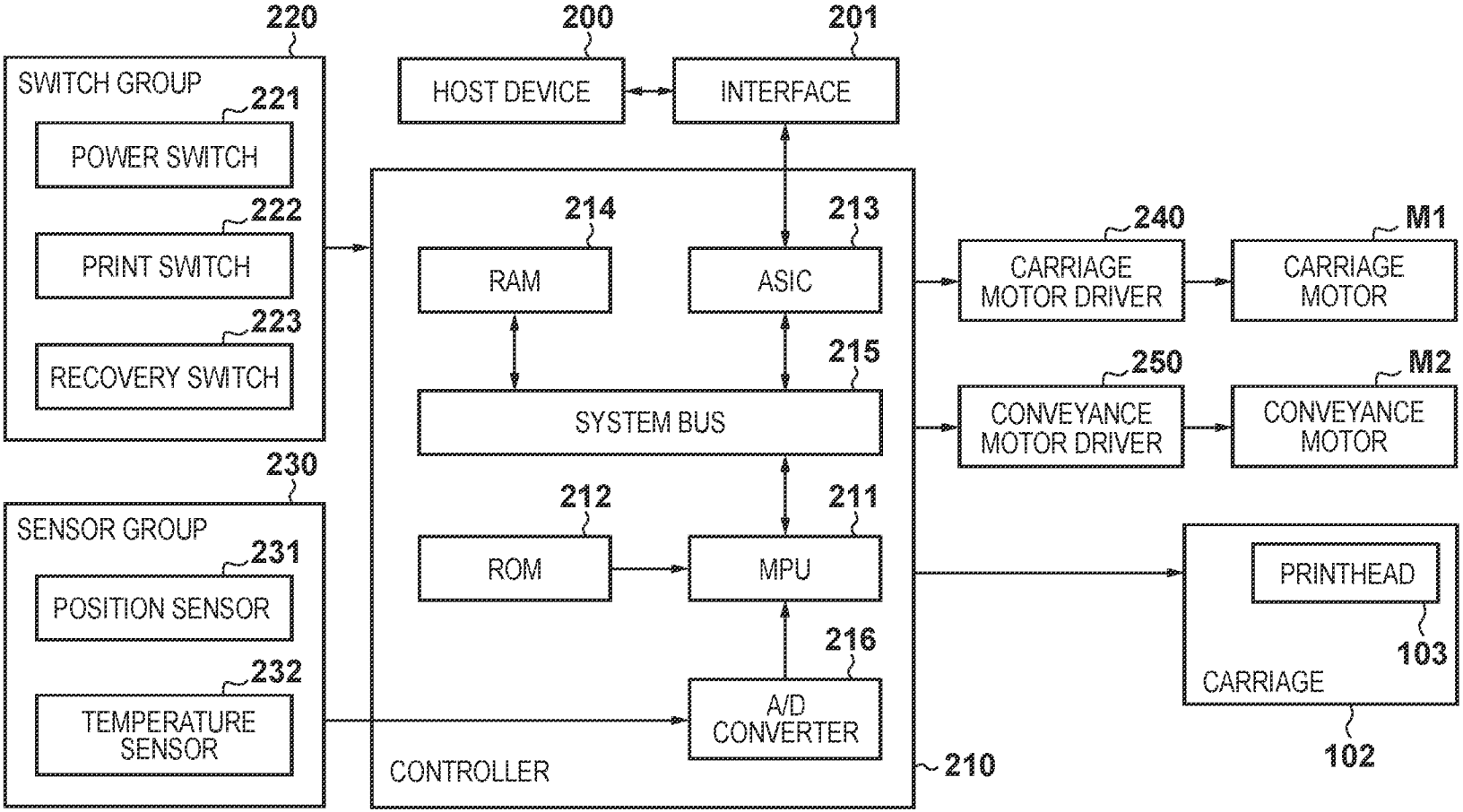
FIG. 2 is a block diagram showing a control configuration of the inkjet printing apparatus.

FIG. 2 is a block diagram showing a control configuration of the inkjet printing apparatus 100 shown in FIG. 1.

As shown in FIG. 2, a controller 210 is configured to include an MPU 211; a ROM 212 that stores a program corresponding to a control sequence described later, required tables, and other prescribed data; an application-specific integrated circuit (ASIC) 213 that generates control signals for control of the carriage motor M1 and the conveyance motor M2, and for control of the printhead 103; a RAM 214 provided with regions for image data expansion, operational regions for program execution, or the like; a system bus 215 for connecting the blocks to each other to carry out exchanges of data; and an A/D converter 216 that inputs analog signals from sensor groups described below, performs A/D conversion, and supplies digital signals to the MPU 211.

Furthermore, in FIG. 2, a host device 200 is a computer (or an image-reading reader or digital camera or the like), which is a supply source of image data. Image data, commands, and status signals and the like are exchanged between the host device 200 and the inkjet printing apparatus 100 via an interface (I/F) 201.

Further still, a switch group 220 is constituted by switches for receiving instructional input from an operator, such as a power switch 221, a print switch 222 for instructing print commencement, and a recovery switch 223 for instructing activation of a process (recovery process) for maintaining a good state of ink discharge capabilities of the printhead 103. A sensor group 230 is a sensor group for detecting states of the inkjet printing apparatus 100 and is constituted by sensors such as a position sensor 231 such as a photocoupler for detecting a home position and a temperature sensor 232 provided in a suitable location of the inkjet printing apparatus 100 for detecting an environmental temperature.

Further still, a carriage motor driver 240 drives the carriage motor M1 for causing the carriage 102 to reciprocally scan in the arrow A direction shown in FIG. 1. Furthermore, a conveyance motor driver 250 drives the conveyance motor M2 for conveying the printing medium P.

The ASIC 213 transfers drive data of the printing elements (discharge heaters) to the printhead while directly accessing a storage region of the ROM 212 during print scans of the printhead 103.

It should be noted that the configuration shown in FIG. 1 is a configuration in which the ink cartridges 106 and the printhead 103 can be separated, but this may also be configured as a head cartridge in which these are integrally formed and exchanged.

Further still, in the following embodiment, the liquid droplets discharged from the printhead are described as ink and also the liquid accommodated in the ink tank is described as ink, but the material that is accommodated is not limited to ink. For example, a material such as a processing liquid to be discharged onto the printing medium to increase the fixing qualities or water resistance of the printed image or to improve the image quality may be accommodated in the ink tank.

In the following embodiment, among inkjet printing methods, in particular a configuration is provided (such as an electrothermal transducer or a laser beam for example) that generates thermal energy as an energy to be used for carrying out ink discharge, and by using a method in which a change in the state of the ink is caused to occur using thermal energy, it is possible to achieve higher density and greater fineness in printing.

Further still, as a full line type printhead having a length corresponding to a greatest width of printing medium that the inkjet printing apparatus 100 is capable of printing, it is possible to use either a configuration in which that length is achieved by combining multiple printhead as disclosed in the specification described above, or a configuration in which this is an integrally formed single printhead.

Additionally, it is possible to use not only a cartridge type printhead in which an ink tank is arranged integrally to the printhead itself as described above, but also a readily replaceable chip type printhead that is mounted onto the apparatus main unit, thereby enabling electrical connections with the apparatus main unit and supply of ink from the apparatus main unit.

Further additionally, instead of an image output terminal of an information processing device such as a computer integrally or separately provided as an example of the inkjet printing apparatus 100 according to the present embodiment, other examples include a copying apparatus combined with a reading device or the like, and further still a facsimile machine having a transmission and reception function.

Figure 3:
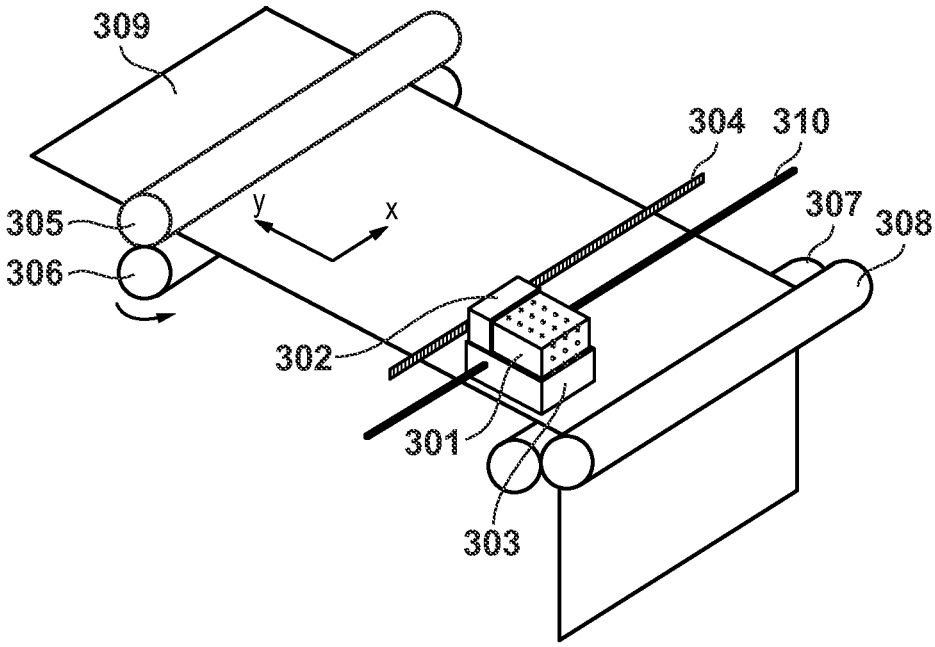
FIG. 3 is a perspective view showing an outline configuration around a printing unit of the inkjet printing apparatus.

FIG. 3 is a perspective view showing an outline configuration around a printing unit of the inkjet printing apparatus 100 according to the present embodiment. In this diagram, an ink cartridge 301 separately stores four colors of ink, these being black (Bk), cyan (C), magenta (M), and yellow (Y), and is configured integrating a storage chamber for each of these. A head cartridge 302 houses two rows per color of printing element rows, in which multiple printing elements are arrayed corresponding to the inks stored in the ink cartridge 301, for a total of eight rows. That is, the head cartridge 302 houses two rows each for each of the colors of ink of Bk, C, M, and Y to be discharged from the printing element rows, this being four colors for a total of eight rows printing element rows. A carriage 303 is capable of having detachably mounted thereon the ink cartridge 301 and the head cartridge 302. The carriage 303 can move along a guide shaft 310 by slidably engaging with the guide shaft 310.

Figure 12A:
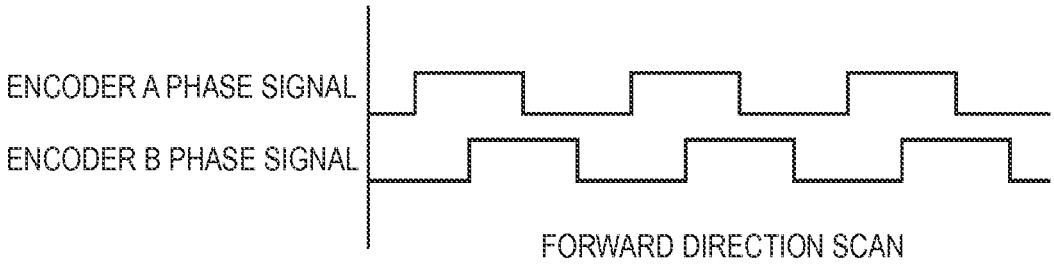
FIG. 12A and FIG. 12B are diagrams showing configurations of encoder signals.
Figure 12B:
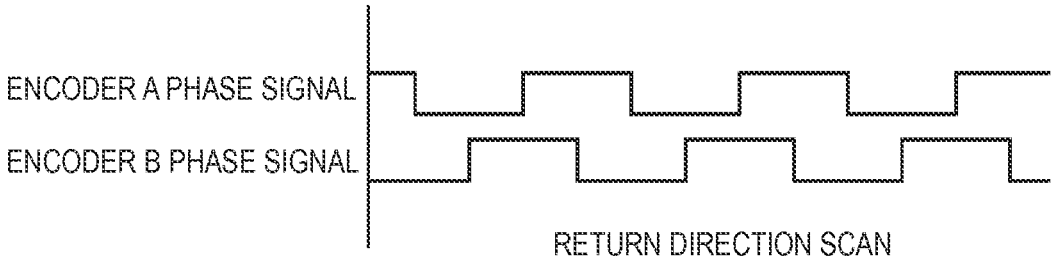
Figure 13:
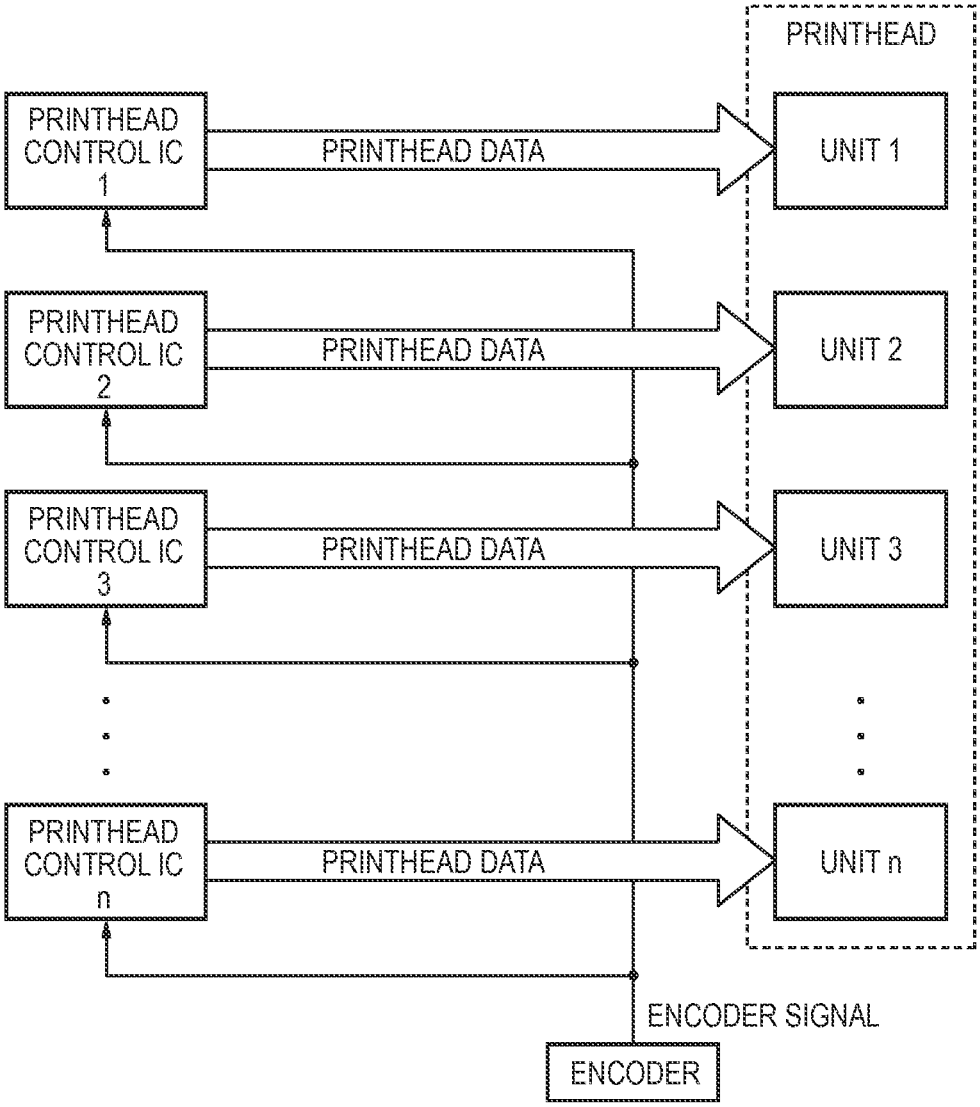
FIG. 13 is a diagram showing a configuration including multiple printhead control ICs.
Figure 14:
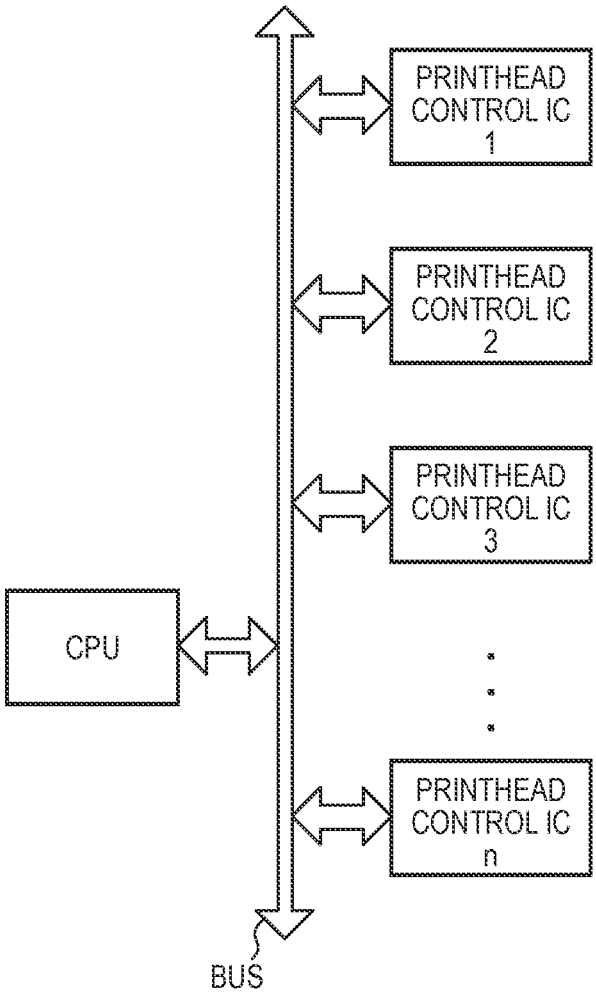
FIG. 14 is a diagram showing a connection configuration between a CPU and multiple printhead control ICs.
Figure 15:
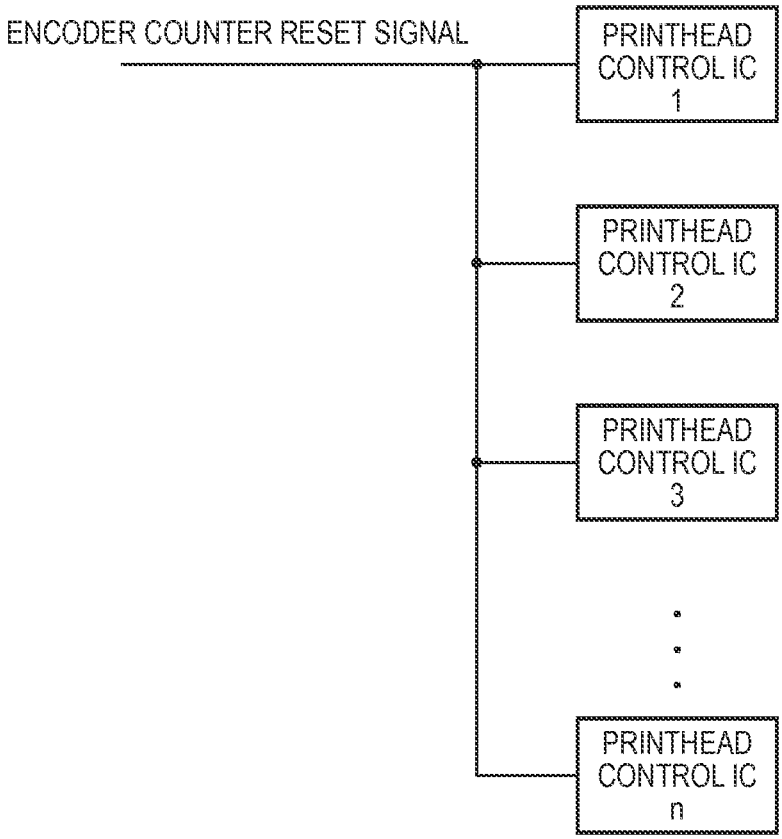
FIG. 15 is a diagram showing another connection configuration between a CPU and multiple printhead control ICs.

An encoder scale 304 is configured on a surface facing the carriage 303, and is provided with slits at 150 lpi intervals. The encoder scale 304 is an encoder film for example, and on the encoder film are regions where light from a light-emitting portion of an encoder sensor (not shown in diagram) penetrate and regions where this light does not penetrate, and the above-mentioned slits are constituted by these two regions. The light emitted from the light-emitting portion of the encoder sensor is irradiated onto the encoder scale 304. A light-receiving portion of the encoder sensor optically reads (receives light that has penetrated) the encoder film, and outputs a pulse signal, which is proportional to a scanning direction movement amount of the carriage 303, as an encoder signal. As shown in FIG. 12A and FIG. 12B, the encoder signals include an A phase signal and a B phase signal, and the B phase signal lags the A phase signal by a 90 degree phase. A paper feeding roller 305 sandwiches a printing medium 309 with an assistive roller 306, and is capable of conveying the printing medium 309 in the y direction shown in FIG. 3 by rotating in the direction of the curved arrow in FIG. 3. Furthermore, a pair of feed rollers 307 and 308 carry out paper feeding while sandwiching the printing medium 309.

Figure 4:
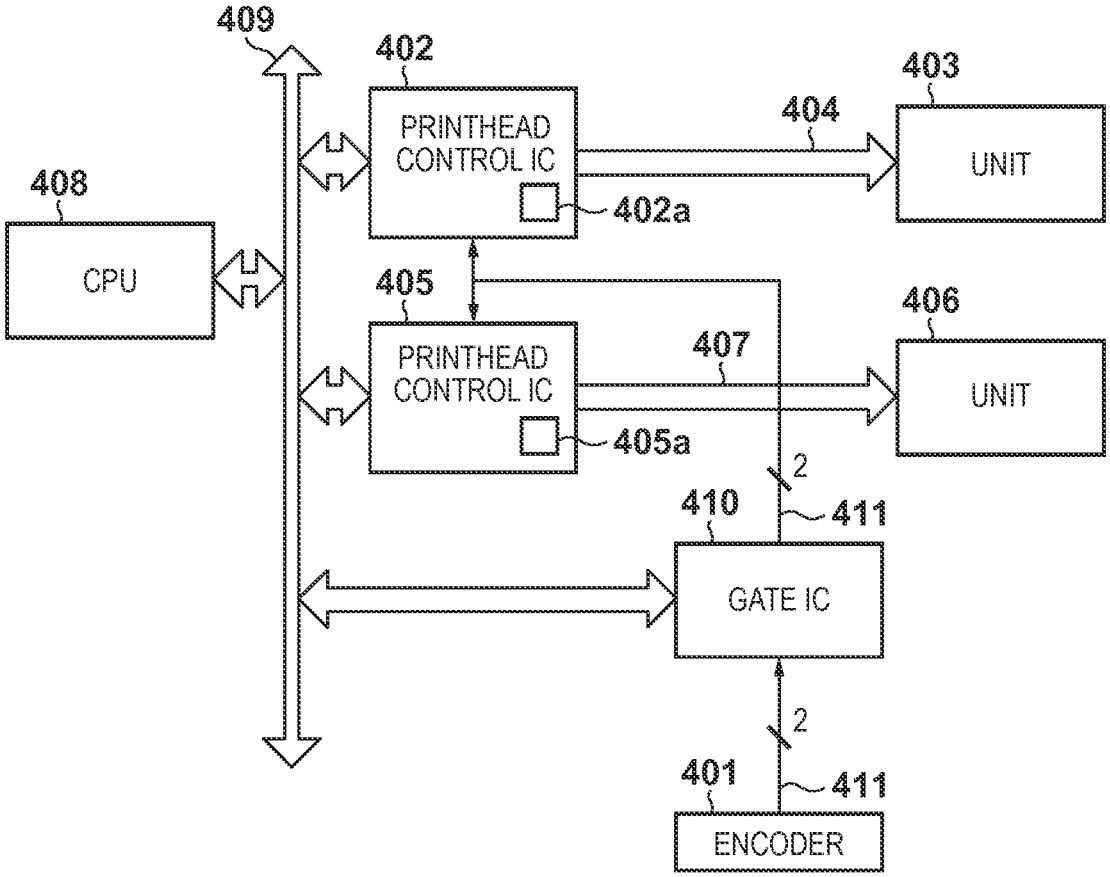
FIG. 4 is a diagram showing a configuration around a printhead controller according to embodiment 1.

FIG. 4 is a diagram showing a configuration around a printhead controller of the inkjet printing apparatus 100. An encoder 401 outputs the A phase signal and the B phase signal based on the position of the carriage 303. Printhead control ICs 402 and 405 control the driving of printing elements. The printhead control ICs 402 and 405 store the number of pulses of encoder signals (pulse signals) outputted from the encoder 401 as a count value in a register (encoder counter) or a memory or the like. Based on these count values, the printhead control ICs 402 and 405 transfer image data for carrying out printing or pulse data for carrying out ink discharge to each of the units for controlling each part of the printhead. For example, each of the printhead control ICs 402 and 405 is able to control driving of a group of printing elements provided in the printhead. In the present embodiment, the printhead is divided into a unit 403 and a unit 406. Here, the unit 403 indicates a configuration for ink discharge of black (Bk) and cyan (C) of the printhead, and the printhead control IC 402 controls the ink discharge of black and cyan. Furthermore, the unit 406 indicates a configuration for ink discharge of magenta (M) and yellow (Y) of the printhead, and the printhead control IC 405 controls the ink discharge of magenta and yellow. The printhead control ICs 402 and 405 are ICs having equivalent configurations. The printhead control IC 402 is provided with an encoder counter 402*a*, and the printhead control IC 405 is provided with an encoder counter 405*a*.

The printhead control IC 402 and the unit 403 are connected by a signal line 404. The signal line 404 transmits image data and pulse data in regard to black and cyan. The printhead control IC 405 and the unit 406 are connected by a signal line 407. The signal line 407 transmits image data and pulse data in regard to magenta and yellow.

A CPU 408 is connected with each block via a bus 409 and carries out register setting and interrupt processing and the like for each block. The encoder 401 and the printhead control ICs 402 and 405 are connected by signal lines 411. The signal lines 411 are provided with two signal lines that transmit the A phase signal and the B phase signal respectively. A gate IC 410 is provided with one group of two input ports and one group of two output ports. One of the input ports of the gate IC 410 connects to the A phase signal outputted from the encoder 401 and the other of the input ports connects to the B phase signal outputted from the encoder 401. One of its output ports connects to a signal line for sending the A phase signal to the printhead control ICs 402 and 405, and the other of its output ports connects to a signal line for sending the B phase signal to the printhead control ICs 402 and 405. The gate IC 410 also connects to the bus 409, and the CPU 408 carries out settings of an internal register of the gate IC 410. Each of the internal circuits of the printhead control IC 402 and the printhead control IC 405 as well as the gate IC 410 maintains synchronization according to a clock.

Figure 5:
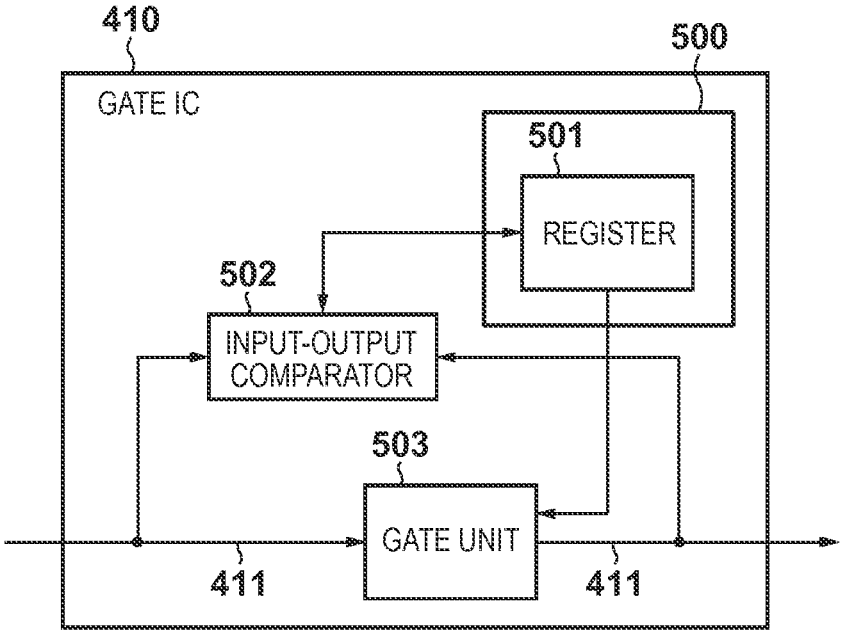
FIG. 5 is a diagram showing a detailed configuration of a gate IC.

FIG. 5 is a diagram showing a detailed configuration of the gate IC 410. A controller 500 is provided with a register 501. The register 501 stores a register inside the gate IC 410 and can be set from the CPU 408 via the bus 409. Based on instructions from the controller 500, an input-output comparator 502 carries out a comparison of the levels of input to a gate unit 503 and output from the gate unit 503. A comparison result thereof is outputted to the controller 500. The input-output comparator 502 carries out a level comparison for the A phase signal and a level comparison for the B phase signal respectively. Regarding the gate unit 503, the gate unit is controlled based on instructions of the controller 500. According to a register setting of the register 501 by the CPU 408, the gate unit 503 is capable of blocking the signal inputted to the gate unit 503 so that there is no output from the gate unit 503.

Figure 6:
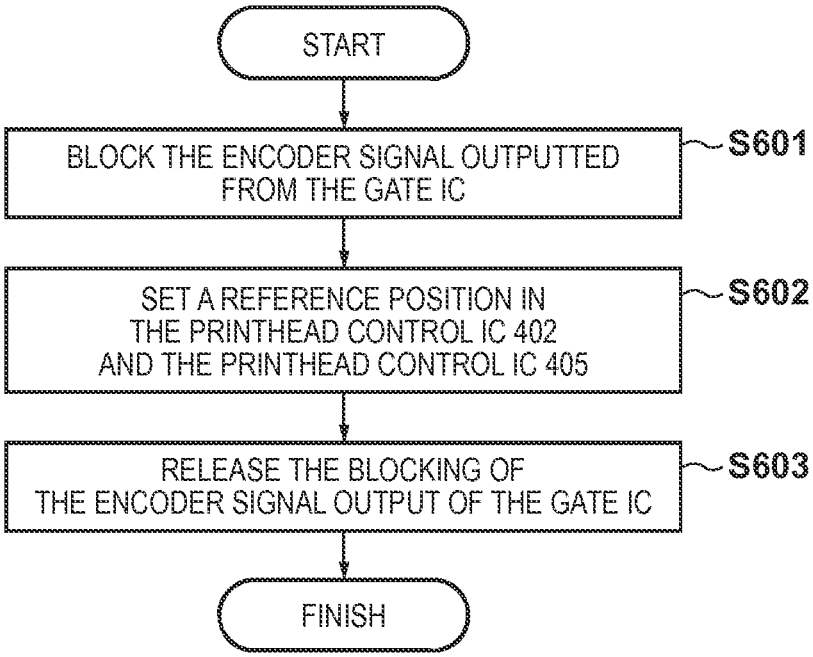
FIG. 6 is a diagram showing a procedure of a process of an encoder counter reset operation.

FIG. 6 is a flowchart showing a procedure of a process of an encoder counter reset operation for the printhead control ICs 402 and 405 according to the present embodiment. The processing indicated in FIG. 6 is executed by the CPU 408 for example. First, at 5601, the CPU 408 carries out a process by which the carriage 303 is stopped, then performs control so that according to the register setting of the register 501, the gate unit 503 is blocked and the encoder signal being outputted from the encoder 401 is not outputted from the gate unit 503. The A phase signal and the B phase signal outputted from the gate unit 503 at this time may be fixed to an H level or an L level. Alternatively, it may be fixed to the level of the A phase signal and the B phase signal that were being outputted from the gate unit 503 when the gate unit 503 was blocked.

Next, at S602, the CPU 408 resets the encoder counter registers in the printhead control ICs 402 and 405 via the bus 409, thereby setting a carriage reference position. That is, a predetermined value is set in the encoder counter registers. The reset may be achieved by changing the value by zeroing the register for example. In this way, in the present embodiment, a reset operation is carried out for the encoder counter of each of the printhead control ICs after the gate unit 503 is blocked to stabilize the level of the A phase signal and the B phase signal inputted to the printhead control ICs 402 and 405 (a change is carried out to the pre-blocking encoder counter value). As a result, it is possible to avoid producing any displacement in the setting of the carriage reference position in each of the printhead control ICs.

At S603, the CPU 408 releases the blocking of the encoder signal of the gate unit 503. Here, as shown in FIG. 12A and 12B, simultaneously changing the A phase signal and the B phase signal of the encoder signal cannot occur due to the configuration of the encoder signals. However, it is possible that the carriage 303 is stopped in a position where there is a risk of chattering occurring, and setting of the reference position is carried out as shown in FIG. 6, then chattering is generated at the instant the blocking of the gate unit 503 is released such that the A phase signal and the B phase signal change simultaneously in an undesirable manner. Accordingly, when releasing the block at S603, the releases of the blocking of the A phase signal and the B phase signal are carried out with a time difference so that the levels of the A phase signal and the B phase signal do not change simultaneously. By providing a time difference between the release timing of the A phase signal and the release timing of the B phase signal in this manner, it is possible to suppress malfunctions of the encoder counters 402*a* and 405*a*. Note however that if the input and output of the A phase signal and the input and output of the B phase signal are both the same level, then the release may be performed without setting a time difference between the A phase signal and the B phase signal. With this type of configuration, it is possible to avoid undesirably inputting a signal of a state that would not be possible in a normal encoder signal to the printhead control ICs.

Figure 7:
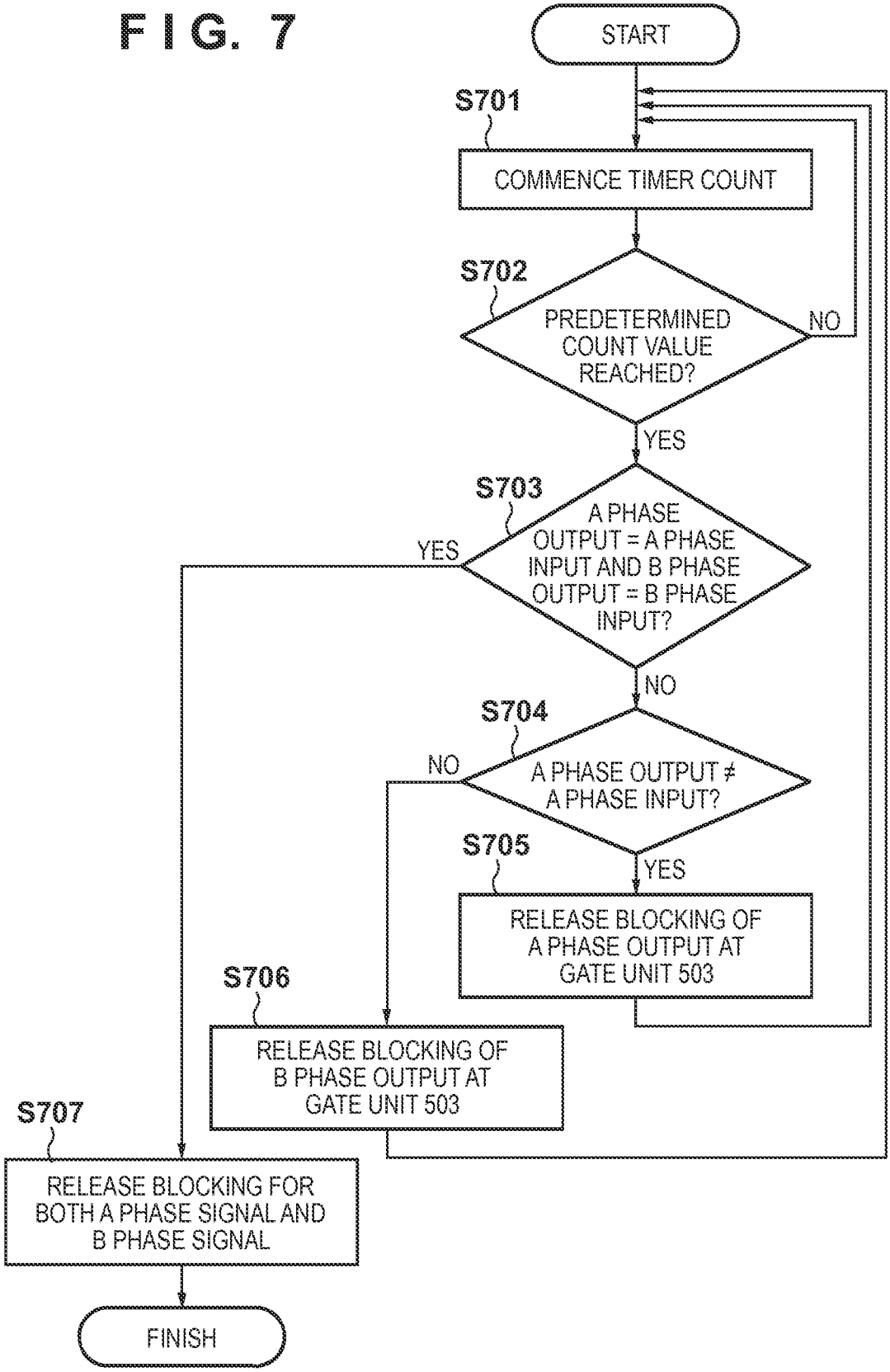
FIG. 7 is a diagram showing a procedure of a blocking release process shown in S603.

FIG. 7 is a flowchart showing a procedure of the blocking release process shown in S603. First, at S701, the CPU 408 commences a count of an inbuilt timer. At S702, the CPU 408 determines whether or not the count value thereof has reached a preset value. In a case where it is determined at S702 that the count value has not reached the preset value, the procedure returns to S701. On the other hand, in a case where it is determined that the count value has reached the preset value, the procedure proceeds to S703. Here, the preset count value is a value for providing a time difference between the release process of the A phase signal to be carried out at S705 and the release process of the B phase signal to be carried out at S706. If there is a specific time difference between the releasing of the A phase signal and the B phase signal, then it is possible to avoid undesirably performing input to each of the printhead control ICs of a state in which the A phase signal and the B phase signal have changed simultaneously.

At S703, the CPU 408 determines whether or not the levels of the A phase signal inputted to the gate unit 503 and the A phase signal outputted from the gate unit 503 are equivalent and whether or not the B phase signal inputted to the gate unit 503 and the B phase signal outputted from the gate unit 503 are equivalent. At S703, in a case where the input and output levels are different in regard to the A phase signal or the B phase signal, the procedure proceeds to S704. On the other hand, in a case where the input and output levels are equivalent in regard to both the A phase signal or the B phase signal, the procedure proceeds to S707. The input and output levels being equivalent in regard to both the A phase signal and the B phase signal signifies that no chattering has occurred in either signal, and therefore in this case there is no problem in simultaneously releasing the blocking of both signals. Accordingly, at S707, the CPU 408 releases the blocking for both the A phase signal and the B phase signal.

At S704, the CPU 408 determines whether or not the output and input levels are equivalent in regard to the A phase signal. At S704, in a case where the output and input levels are determined to be not equivalent in regard to the A phase signal, the procedure proceeds to S705. At S705, the CPU 408 accesses the register 501 of the gate IC 410 and releases the blocking in regard to the A phase signal at the gate unit 503. After this, the procedure returns to S701. On the other hand, in a case where the output and input levels are determined to be equivalent in regard to the A phase signal at S704, the procedure proceeds to S706.

In the case of proceeding to S706, it is evident from the branch conditions of S703 and S704 that the output and input levels are equivalent in regard to the A phase signal and that the output and input levels are different in regard to the B phase signal. Accordingly, at S706, the CPU 408 accesses the register 501 of the gate IC 410 and releases the blocking in regard to the B phase signal at the gate unit 503. After this, the procedure returns to S701.

That is, in the present embodiment, when releasing the A phase signal and the B phase signal at the gate unit 503, the release is performed with a time difference of a preset time amount. By doing this, it is possible to avoid undesirably inputting to the printhead control ICs a state that would not be possible in a normal encoder signal, which is the A phase signal and the B phase signal changing simultaneously.

It should be noted that in FIG. 7, blocking of the A phase signal is released at S705 and blocking of the B phase signal is released at S706, but other configurations may be used as long as a time difference is implemented for the releases of the A phase signal and the B phase signal. That is, it is possible to release the blocking of the B phase signal in a case where it has been determined at S705 that the input and output levels of the B phase signal are not equivalent, and to release the blocking of the A phase signal in a case where it has been determined at S706 that the input and output levels of the B phase signal are not equivalent.

Furthermore, in the present embodiment, description was given for a case in which there were two printhead control ICs, but an equivalent configuration and procedure can be applied in a case where an n number (n is natural number) of printhead control ICs is used due to an increase in the number of colors of printhead.

Embodiment 2

Figure 9:
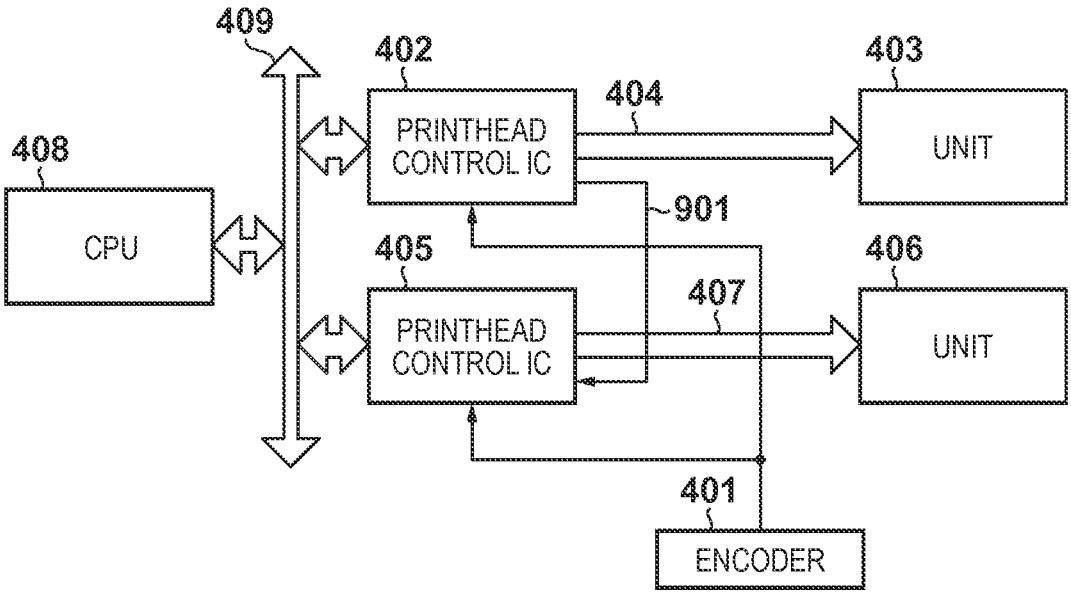
FIG. 9 is a diagram showing a configuration around a printhead controller according to embodiment 2.

FIG. 9 is a diagram showing a configuration around a printhead controller of the inkjet printing apparatus 100 according to the present embodiment. FIG. 9 is different compared to FIG. 4 in which embodiment 1 is shown in that there is no gate IC 410 and in that the printhead control IC 402 and the printhead control IC 405 are connected by a signal line 901. The encoder counters of the printhead control IC 402 and the printhead control IC 405 are omitted to simplify the diagram.

The signal line 901 outputs a reference position setting trigger from the printhead control IC 402 to the printhead control IC 405. That is, when the signal line 901 is asserted (made active), the reference position of the carriage 303 is set inside the printhead control ICs 402 and 405. A register is provided inside the printhead control ICs 402 and 405 for carrying out a setting of whether to use itself as a master or slave. The printhead control IC that is set as the master by the CPU 408 outputs the reference position setting trigger at a predetermined timing using a method described later to the printhead control IC that is set as the slave. In the present embodiment, the printhead control IC 402 is set as the master and the printhead control IC 405 is set as the slave.

Figure 10:
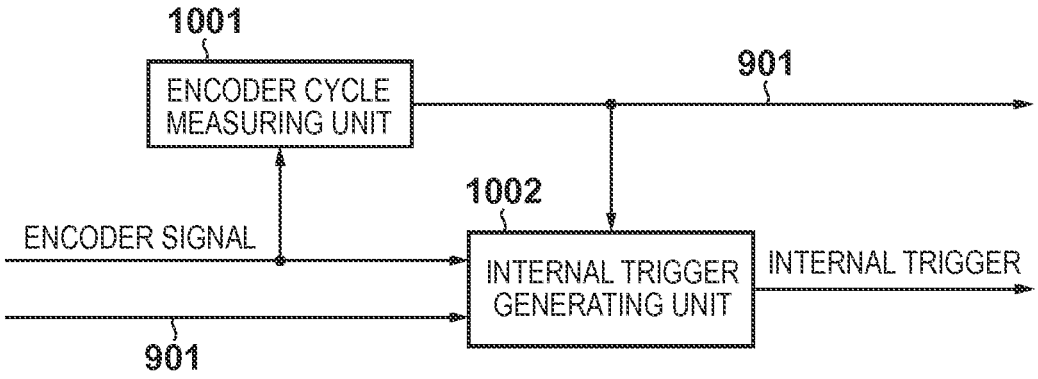
FIG. 10 is a block diagram of portions that control encoder signals inside a printhead control IC.

FIG. 10 is a block diagram of portions that control the encoder signals inside the printhead control IC 402 or 405. First, description is given in regard to the printhead control IC 402 that is set as the master. An encoder cycle measuring unit 1001 measures a cycle of the encoder signal by detecting a rising edge of the A phase signal of the encoder signal. At a time of setting the reference position of the carriage 303, the encoder cycle measuring unit 1001 continuously measures multiple cycles (for example, 10 cycles) of the encoder signal cycle. In the present embodiment, in a case where each of the results of the measured values of the continuous 10 cycles is within a range of ±10 microseconds from a reference value, the encoder cycle measuring unit 1001 determines that the carriage 303 is scanning at a fixed velocity. The encoder cycle measuring unit 1001 outputs the reference position setting trigger indicating the timing of the reference position setting of the carriage 303 to an internal trigger generating unit 1002 and simultaneously outputs that reference position setting trigger by asserting (making active) the signal line 901. Based on the inputted encoder signal, the internal trigger generating unit 1002 generates and outputs a timing trigger for commencing transfer to the printhead of discharge data or print pulses. Furthermore, the internal trigger generating unit 1002 inputs the reference position setting trigger from the encoder cycle measuring unit 1001.

Next, description is given in regard to the printhead control IC 405 that is set as the slave. The functions of the encoder cycle measuring unit 1001 and the internal trigger generating unit 1002 are the same as in the printhead control IC 402. However, in the printhead control IC 405, the reference position setting trigger inputted to the internal trigger generating unit 1002 via the signal line 901 from the printhead control IC 402 is made valid. That is, in the printhead control IC 405, the reference position setting trigger inputted to the internal trigger generating unit 1002 from the encoder cycle measuring unit 1001 is made invalid.

By doing this, in the present embodiment, due to the signal line 901, the reference position setting trigger outputted from the master printhead control IC is outputted to the other printhead control IC that is the slave. Each of the printhead control ICs carries out setting of the reference position of the carriage 303 according to this reference position setting trigger by resetting the encoder counter held in its own IC.

Figure 11:
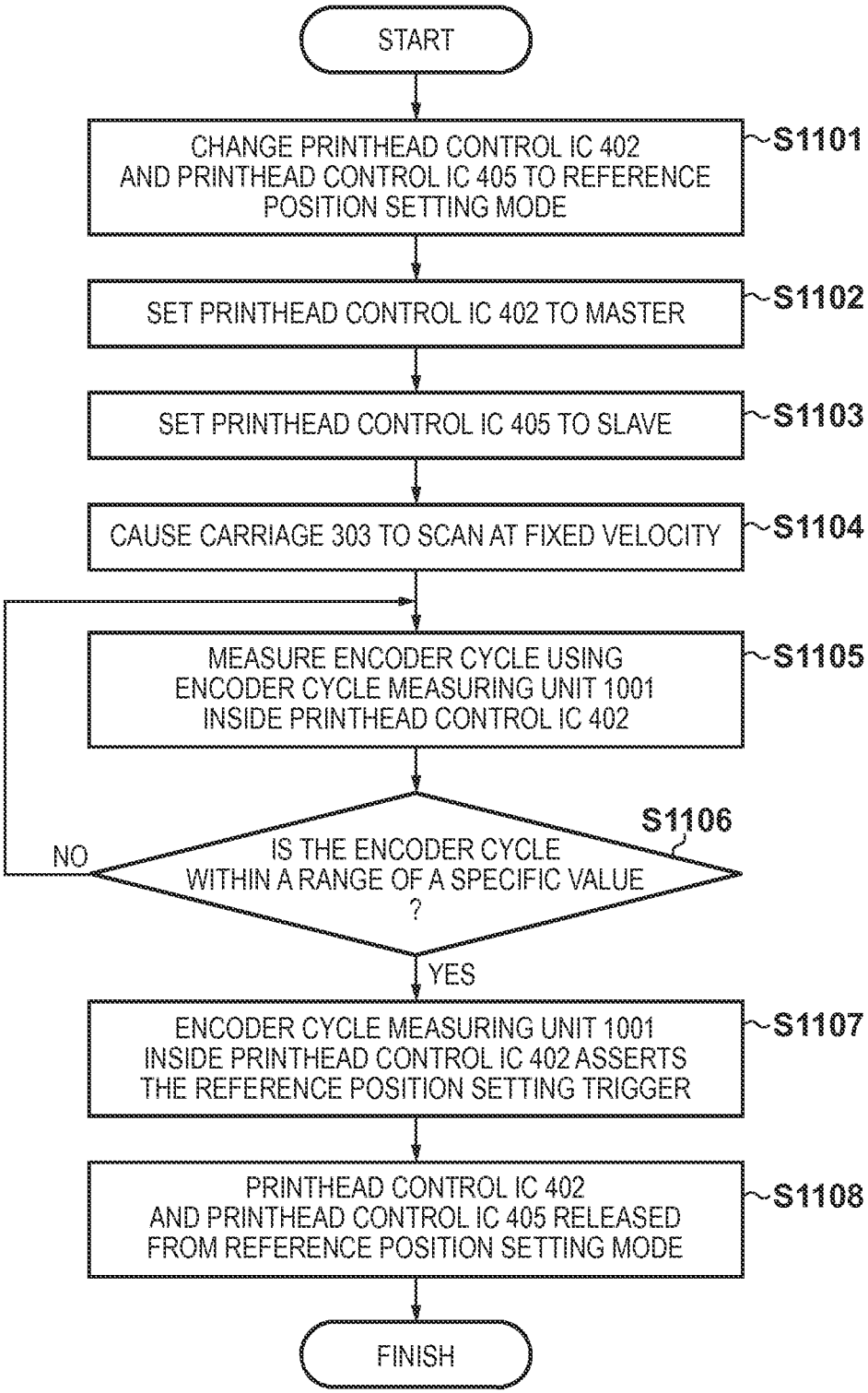
FIG. 11 is a diagram showing a procedure of a process of an encoder counter reset operation.

FIG. 11 is a flowchart showing a procedure of a process of an encoder counter reset for the printhead control ICs 402 and 405 according to the present embodiment. Each of the processes indicated in FIG. 11 is executed by the CPU 408 for example. First, the CPU 408 stops the carriage 303 at the home position. At S1101, the CPU 408 changes the printhead control ICs 402 and 405 to reference position setting mode. This change is carried out for example by a register setting inside each of the printhead control ICs. At S1102, the CPU 408 sets the printhead control IC 402 as master. At S1103, the CPU 408 sets the printhead control IC 405 as slave.

At S1104, the CPU 408 moves the carriage 303 from the home position at a fixed velocity. In the present embodiment, the setting of the reference position is carried out while the carriage 303 is moving as is described later, and therefore it is not necessary to stop the carriage 303. For example, a resetting method according to the present example can be used in such cases as where the carriage 303 is caused to scan at a slow velocity during normal printing.

At S1105, the encoder cycle measuring unit 1001 inside the printhead control IC 402, which is set as master, measures the cycles of the encoder signal continuously for 10 cycles for example. At S1106, the encoder cycle measuring unit 1001 of the printhead control IC 402 compares each of the measured values of the 10 continuous cycles of the encoder signal with a reference value and determines whether or not these are within a range of ±10 microseconds. In a case where it is determined at S1106 that the measured values are not within a range of ±10 microseconds, the procedure returns to S1105 and the cycles of the encoder signal are measured again. On the other hand, in a case where it is determined at S1106 that the measured values of the 10 continuous cycles of encoder signal are within a range of ±10 microseconds, the procedure proceeds to S1107.

At S1107, the encoder cycle measuring unit 1001 of the printhead control IC 402 asserts the signal line 901 to output the reference position setting trigger to the printhead control IC 405. At this timing, the setting of the reference position of the carriage 303 is carried out for the printhead control ICs 402 and 405. At S1108, the CPU 408 releases the printhead control ICs 402 and 405 from the reference position setting mode.

Figure 8:
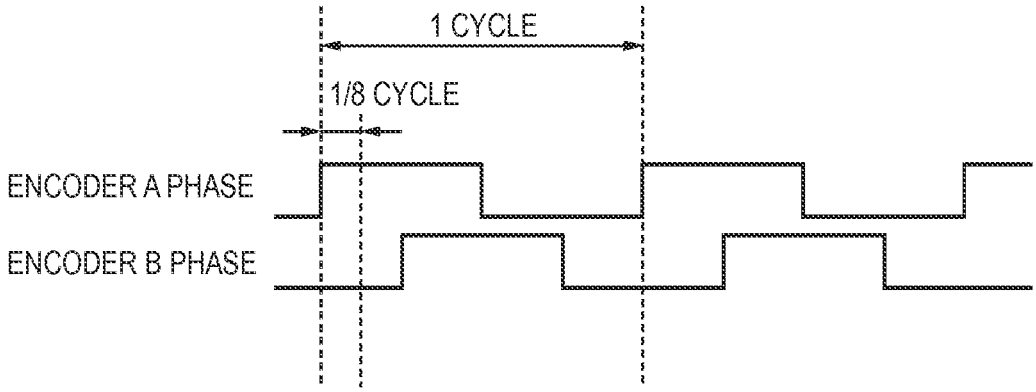
FIG. 8 is a diagram showing change in an A phase signal and a B phase signal.

Description is given regarding a method for deciding a timing for setting the reference position of the carriage 303. As shown in FIG. 8, a timing for when there is no change in the level of either the A phase signal or the B phase signal of the encoder signal is, for example, a timing from a rising edge of the A phase signal until an amount of time of ⅛ of a cycle of the encoder signal has elapsed. Accordingly, of the 10 measured cycles, the first cycle is set as a reference encoder cycle. Then, using a timing from a time at which a rising edge of the A phase signal of the encoder signal has been detected until an amount of time of ⅛ of cycle has elapsed, the printhead control IC 402 outputs the reference position setting trigger via the asserted signal line 901 to the printhead control IC 405. That is, in the present embodiment, setting of the reference position of the carriage 303 is carried out using a timing of stability in which chattering does not occur of the encoder signals outputted from the encoder sensor. In looking at the A phase signal shown in FIG. 8, this corresponds to the encoder sensor reading an area outside a predetermined region that includes a boundary between a penetration region and a non-penetration region of light onto the encoder film. Here, "predetermined region" indicates a region in which chattering can occur near a boundary between the penetration region and the non-penetration region on the encoder film.

In the present embodiment, description was given for a case in which there were two printhead control ICs, but an equivalent configuration and procedure can be applied in a case where an n number (n is natural number) of printhead control ICs is used due to an increase in the number of colors of printhead. Furthermore, in the present embodiment, the timing of the rising edge of the A phase signal is set as a reference to carry out measurements of the cycles of the encoder signal. However, it is also possible to use as a reference for the timing a trailing edge of the A phase signal or a rising edge or a trailing edge of the B phase signal.

Furthermore, in the present embodiment, in a case where each of the measured values of the continuous 10 cycles of the encoder signal is within a range of ±10 microseconds from the reference value, it is determined that the carriage 303 is moving at a fixed velocity. However, the number of times of measurements and the range of times for determining that the carriage is moving at a fixed velocity may be values other than these. Furthermore, in the present embodiment, the first cycle of the 10 cycles that are measured is set as the reference cycle of the encoder signal, but it is also possible to use any of the second to tenth cycles as the reference cycle.

Other Embodiments

Aspects of the present invention can also be realized by a computer of a system or apparatus (or devices such as a CPU or MPU) that reads out and executes a program recorded on a memory device to perform the functions of the above-described embodiments, and by a method, the steps of which are performed by a computer of a system or apparatus by, for example, reading out and executing a program recorded on a memory device to perform the functions of the above-described embodiments. For this purpose, the program is provided to the computer for example via a network or from a recording medium of various types serving as the memory device (e.g., computer-readable medium).

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-184062, filed Aug. 25, 2011, which is hereby incorporated by reference herein in its entirety.

What is claimed is:

1. A printing apparatus, comprising:

a generation unit configured to generate a first pulse signal and a second pulse signal with a phase shifted relative to the first pulse signal, wherein the first pulse signal and the second pulse signal are associated with movement of a printhead in which printing elements are grouped into a plurality of groups, and the first pulse signal and the second pulse signal indicate a position in a scanning direction of the printhead;

multiple control units configured to control driving of the printhead, wherein each of the multiple control units includes a count unit that counts position information of the printhead based on the first pulse signal and the second pulse signal generated by the generation unit, and corresponds to one of the plurality of groups; and a supply unit configured to receive the first pulse signal and the second pulse signal generated by the generation unit and configured to control supplying the first pulse signal and the second pulse signal to the multiple control units, wherein the supply unit comprises a stopping unit configured to stop supply of the first pulse signal and the second pulse signal to be supplied to the multiple control units in a case where a count value counted by the count unit is set to a reference value indicating a reference position in the scanning direction of the printhead.

2. The printing apparatus according to claim 1, wherein the stopping unit includes a comparison unit configured to compare each level of the first pulse signal and the second pulse signal generated by the generation unit with each level of the first pulse signal and the second pulse signal to be supplied to the multiple control units, and release stopping of supply of the first pulse signal and the second pulse signal, at each timing, based on a comparison result of the comparison unit.

3. The printing apparatus according to claim 2, wherein, based on the comparison result, the stopping unit releases stopping of supply of the second pulse signal after a predetermined time has elapsed, after the stopping unit has released stopping of supply of the first pulse signal.

4. The printing apparatus according to claim 1, wherein the multiple control units include a first control unit configured to control driving of printing elements included in a first group of the plurality of groups, and a second control unit configured to control driving of the printing elements included in a second group of the plurality of groups.

5. The printing apparatus according to claim 1, further comprising:

a movement unit configured to move the printhead; and a movement control unit configured to control the movement unit to move or stop the printhead, wherein after the movement control unit controls the movement unit to stop the printhead, a count value counted by the count unit is instructed to be set to the reference value for each of the multiple control units.

6. The printing apparatus according to claim 1, wherein the generation unit comprises an encoder sensor.

7. The printing apparatus according to claim 1, wherein the stopping unit receives an input of the first pulse signal and the second pulse signal generated by the generation unit, and provides an output of the first pulse signal and the second pulse signal to be supplied to the multiple control units, and wherein the stopping unit stops supply of the first pulse signal and the second pulse signal to be supplied to the multiple control units by cutting a signal route from the input to the output.

8. A control method of a printing apparatus, comprising:

moving a carriage mounting a printhead, in which printing elements are grouped into a plurality of groups, to perform printing;

generating pulse signals by an encoder sensor in association with movement of the carriage, where the pulse signals generated have a phase shifted relative to each other;

controlling driving of the printhead by multiple control units, each of which includes a counter that counts position information of the printhead based on the pulses of the pulse signals supplied to the multiple control units, and corresponds to one of the plurality of groups; receiving by a supply unit the generated pulse signals and stopping supply of the pulse signals to the multiple control units in a case where counters of the multiple control units are to be reset to a reference value indicating a reference position in the scanning direction of the printhead.

9. The control method according to claim 8, wherein the pulse signals include a first pulse signal and a second pulse signal having a phase which is different from that of the first pulse signal, and each of the first pulse signal and the second pulse signal is generated by the encoder sensor.

10. The control method according to claim 9, further comprising respectively releasing stop of supply of the first pulse signal and the second pulse signal at different timings.

11. The control method according to claim 8, wherein the multiple control units include a first control unit configured to control driving of a first group of printing elements included in the printhead and a second control unit configured to control driving of a second group of printing elements different from the first group included in the printhead.

12. The control method according to claim 8, further comprising:

controlling the carriage to move or stop; and setting a predetermined value for each of the counters of the multiple control units after the carriage is controlled to stop.

* * * * *